US011564431B2

(12) United States Patent
Briggs et al.

(10) Patent No.: US 11,564,431 B2
(45) Date of Patent: Jan. 31, 2023

(54) PROTECTIVE BELT APPARATUS

(71) Applicant: BRIGGS BELT SYSTEMS, LLC

(72) Inventors: Leonard C. Briggs, Sewickley Heights, PA (US); Kamal K. Raychaudhuri, Red Bank, NJ (US); Mohammad T. Fatehi, Irvine, CA (US)

(73) Assignee: BRIGGS BELT SYSTEMS, LLC, Sewickley, PA (US)

( * ) Notice: Subject to any disclaimer, the term of this patent is extended or adjusted under 35 U.S.C. 154(b) by 0 days.

(21) Appl. No.: 16/844,049

(22) Filed: Apr. 9, 2020

(65) Prior Publication Data

US 2021/0315300 A1 Oct. 14, 2021

(51) Int. Cl.

| | |
|---|---|
| ***A41D 13/018*** | (2006.01) |
| ***A41D 13/05*** | (2006.01) |
| ***A41F 9/02*** | (2006.01) |
| ***A41F 9/00*** | (2006.01) |
| ***A41D 1/00*** | (2018.01) |

(52) U.S. Cl.

CPC ..... *A41F 9/002* (2013.01); *A41D 1/002* (2013.01); *A41D 13/018* (2013.01); *A41D 13/0506* (2013.01); *A41F 9/02* (2013.01)

(58) Field of Classification Search

CPC .. A41D 13/00; A41D 13/065; A41D 13/0155; A41D 13/0525; A41D 13/0506; A41D 13/0531; A41D 13/06; A41D 13/02; A41D 13/0125; A41D 13/018; A41D 13/0537; A41D 13/0543; A41F 17/02

USPC ..... 2/465, DIG. 3, 338, 300, 309, 313, 22

See application file for complete search history.

(56) References Cited

U.S. PATENT DOCUMENTS

| | | | |
|---|---|---|---|
| 1,080,985 | A | 12/1913 | Leap |
| 3,271,782 | A | 9/1966 | Mallett |
| 3,789,431 | A | 2/1974 | Rand |
| 5,362,098 | A | 11/1994 | Guill |
| 5,500,952 | A | 3/1996 | Keyes |
| 5,937,443 | A | 8/1999 | Kageyama et al. |
| 7,017,195 | B2 | 3/2006 | Buckman et al. |
| 7,150,048 | B2 | 12/2006 | Buckman |
| 9,107,615 | B2 | 8/2015 | Buckman |
| 10,154,695 | B2 | 12/2018 | Jin |
| 2006/0288464 | A1 | 12/2006 | Warden |
| 2009/0254003 | A1 | 10/2009 | Buckman |
| 2012/0090076 | A1 | 4/2012 | Kenney et al. |

(Continued)

*Primary Examiner* — Sally Haden

(74) *Attorney, Agent, or Firm* — Eckert Seamans Cherin & Mellott, LLC

(57) ABSTRACT

A belt apparatus is configured to support the trousers worn by a person and to include a number of airbags that are deployable in a falling event to protect the person from bone breakages. The belt apparatus includes a flexible belt element and a fastener that appear and function in much the same way as an ordinary apparel trouser belt, i.e., fitting through belt loops in trousers and being fastenable to itself to support the pair of trousers at the waist of the person. Despite the ordinary appearance of the belt apparatus, it includes airbags internal thereto whose expansion is controlled by a control apparatus. Responsive to a falling event in a particular direction with respect to the person, the control apparatus triggers the rapid expansion of an airbag that is situated on the belt element in the particular direction with respect to the person and takes other actions.

5 Claims, 10 Drawing Sheets

(56) References Cited

U.S. PATENT DOCUMENTS

| | | | | |
|---|---|---|---|---|
| 2013/0321268 | A1 | 11/2013 | Raanan | |
| 2014/0033413 | A1 | 2/2014 | Richard | |
| 2014/0111339 | A1* | 4/2014 | Beckett | A41D 13/0506 340/573.1 |
| 2014/0123374 | A1 | 5/2014 | Geltson et al. | |
| 2014/0230135 | A1 | 8/2014 | Fenyves | |
| 2015/0101112 | A1 | 4/2015 | Balbien et al. | |
| 2015/0238124 | A1 | 8/2015 | Buckman | |
| 2015/0272248 | A1 | 10/2015 | Briggs | |
| 2015/0351666 | A1 | 12/2015 | Buckman | |
| 2017/0181485 | A1 | 6/2017 | Jin | |
| 2017/0208874 | A1 | 7/2017 | Davenport et al. | |
| 2017/0224031 | A1 | 8/2017 | Raanan | |
| 2017/0281056 | A1 | 10/2017 | Raanan et al. | |

* cited by examiner

PROTECTIVE BELT APPARATUS

CROSS REFERENCE TO RELATED APPLICATION

This application relates to U.S. patent application Ser. No. 16/844,045, filed Apr. 9, 2020.

BACKGROUND

Field

The disclosed and claimed concept relates generally to structures that are intended to protect a person from injury and, more particularly, to a belt apparatus that is structured to resist the breakage of bones as a result of a falling event.

Related Art

A person's bones are understood to gradually become more brittle and thus more subject to breakage as the person ages. It is also understood that a person's muscular tone and strength likewise decreases with age. The loss of muscular tone and strength can, along with other factors, can have a tendency to reduce balance and coordination in an older person, which can contribute to the potential that the person might experience a falling event, i.e., an event wherein the person falls onto a floor, against a wall, or against another object. The reduced muscular tone and strength also reduces the person's ability to catch himself or herself or to otherwise protect himself or herself during a falling event. Furthermore, the aforementioned brittleness of the bones in an aged person increases the likelihood that one or more bones might be broken as a result of a falling event.

It can therefore be said that, as a general matter, aged persons are relatively more likely to experience falling events, and such falling events are likely to involve a relatively greater impact because of the person's inability to catch himself or herself, with the result that an aged person is generally at a greater risk of the breakage of bones than a younger person. It is also generally understood that a significant skeletal break can be sufficiently detrimental to a health of an aged person that the aged person may die as a direct result of the breakage. At the very least, a significant bone breakage in an older person is detrimental to the person's health due to factors such as the increased potential for infection and the physical resources required to heal the bone break, and also due to the pain and suffering experienced by the person, as well as other factors.

Various protective devices are already known to exist. However, such protective devices can be difficult to use, or at least have been less than completely convenient to use. Moreover, certain protective devices have been somewhat unattractive or can be embarrassing for a person to wear on a regular basis. As such, the mere existence of known protective devices has not necessarily alleviated the risk of injury inasmuch as such protective devices often end up being unused.

It thus would be desirable to provide a solution that can help people, particularly aged people, to avoid bone breakages that would otherwise be significantly detrimental to the person's health.

SUMMARY

An improved belt apparatus that meets these needs and other needs is configured to support the trousers worn by a person and to include a number of airbags that are deployable in a falling event to protect the person from bone breakages. The belt apparatus includes a flexible belt element and a fastener that appear and function in much the same way as an ordinary trouser belt, i.e., fitting through belt loops in trousers and being fastenable to itself to be at a selected circumferential length to support the pair of trousers at the waist of the person. Despite the ordinary appearance of the belt apparatus, it includes one or more airbags internal thereto whose expansion is controlled by a control apparatus. Responsive to a falling event in a particular direction with respect to the person, the control apparatus triggers the rapid expansion of an airbag that is situated on the belt element in the particular direction with respect to the person. The expansion is delayed or timed with respect to the initial detection of the falling event to cause the rapid expansion of the airbag to generally coincide with a time just prior to an impact in order to protect those bones of the person that otherwise might have injuriously impacted a floor, a wall, or other structure.

Such an improved belt apparatus may have other features, such as in ability to generate in emergency signal that is wirelessly communicated to a receiver upon the detection of and initiation of a falling event. The emergency signal might include a date, time, and location of the falling event, and might include a medical history of the person or might include and construction to forward the medical history to, for instance, medical or emergency personnel. The improved or alternatively include a data storage that records and stores data pertaining to the belt apparatus but which, upon the detection of a falling event, might render certain of the data in the storage non-rewritable such that the data will remain inviolate until it is, for instance, downloaded by medical personnel, by way of example. The belt apparatus might be configured to detect both in acceleration of the person and in angular velocity of the person and might be configured to detect and initiation of a falling event when either the acceleration exceeds a predetermined acceleration value for the angular velocity exceeds a predetermined angular velocity value. The belt apparatus might additionally include in automatic arming and disarming system that automatically goes to him armed state when the fastener is cooperated with the belt element to retain the belt apparatus at a selected circumferential length.

Furthermore, such a belt apparatus may be provided as part of a kit that includes a plurality of belt elements or a plurality of fasteners or both. In such a situation, for example, a given fastener might be alternatively cooperable with a plurality of belt elements, such as if a given buckle, i.e., fastener, is provided with a belt element that is brown and color as well as an alternative belt element that is black in color. The given buckle might include a control apparatus with a number of sensors, and each belt element might include its own protection apparatus and expansion apparatus. The given buckle could be alternatively connectable with either of the two belt elements as desired by the person by connecting together a connector portion that is situated on the given buckle with a corresponding other connector portion that is situated on the belt element. When the given buckle and the belt element are connected together in such a fashion, the two connector portions together form a connector that functionally connects together the given buckle and the selected belt element such that in the event that the control apparatus on the given buckle detects an initiation of a falling event, the control apparatus will cause the expansion apparatus that is situated on the belt element to expand the protection apparatus.

Accordingly, an aspect of the disclosed and claimed concept is to provide a belt apparatus that appears and functions in exactly the same way as a conventional apparel belt or trouser belt, but that additionally protects the person from injury in a falling event.

Another aspect of the disclosed and claimed concept is to provide an improved belt apparatus that is worn by a person in substantially exactly the same fashion that the person would wear a conventional trouser belt.

Another aspect of the disclosed and claimed concept is to provide improved belt apparatus that performs certain functions in response to a detection of a falling event, such as sending to a receiver an emergency signal that includes certain pertinent information, or storing certain sensor data prior to and/or subsequent to the falling event, or taking other action.

Another aspect of the disclosed and claimed concept is to provide in automatic arming and disarming system wherein the cooperating of the fastener with one of a number of holes formed in the belt element, such as when the belt apparatus is being worn by a person, automatically arms the belt apparatus such that it will expand its airbags during a falling event, and wherein removal of the belt apparatus from the trousers will automatically disarm the belt apparatus such that even if the belt apparatus is dropped on the floor, it will not trigger its airbags.

Another aspect of the disclosed and claimed concept is to provide a belt apparatus that is a part of a kit, with the kit including a plurality of belt elements or a plurality of fasteners, or both, such that any given fastener is alternatively cooperative with any of a plurality of belt elements to alternatively form a plurality of belt apparatuses, and any given belt element is alternatively cooperative with any of a plurality of fasteners to likewise alternatively form a plurality of belt apparatuses, such as when different styles of fasteners and belt elements might be desired to be used, or when a belt element or a fastener simply is worn for use and is in need of replacement.

Another aspect of the disclosed and claimed concept is to provide an improved belt apparatus having a plurality of airbags, which detects a falling event in a particular direction with respect to the person, and which responsively triggers the expansion of an airbag that is situated generally in the particular direction with respect to the person and which thus protects the person and resists the breakage of bones in the particular direction with respect to the person.

Another aspect of the disclosed and claimed concept is to provide an improved belt apparatus which, during a falling event in a particular direction with respect to the person, deploys certain airbags situated generally in the particular direction with respect to the person without necessarily deploying all of the airbags of the belt apparatus.

These and other aspects of the disclosed and claimed concept are provided by an improved belt apparatus structured to be in wireless communication with a receiver and further structured to support on a person a trousers having a number of belt loops that are situated on an exterior surface of the trousers. The belt apparatus can be generally stated as including a trouser support apparatus that can be generally stated as including an elongated and flexible belt element having a number of cavities formed therein, the belt element being structured to be received in the number of belt loops of the trousers to thereby assist in supporting the trousers at the waist of the person, a protection apparatus that can be generally stated as including a number of cushion elements that are each structured to be movable from a configuration situated within a cavity of the number of cavities to another configuration situated at least partially outside the cavity and in protective proximity to a body part of the person, a control apparatus that can be generally stated as including a number of sensors and being structured to generate a trigger signal responsive to a detection of an initiation of a falling event of the person, an expansion apparatus which, responsive to the trigger signal, is structured to expand at least a first cushion element of the number of cushion elements from the configuration to the another configuration, and a notification apparatus which, responsive to the trigger signal, is structured to wirelessly communicate to the receiver an emergency signal.

Other aspects of the disclosed and claimed concept are provided by an improved belt apparatus structured to support on a person a trousers having a number of belt loops that are situated on an exterior surface of the trousers. The belt apparatus can be generally stated as including a trouser support apparatus that can be generally stated as including an elongated and flexible belt element having a number of cavities formed therein, the belt element being structured to be received in the number of belt loops of the trousers to thereby assist in supporting the trousers at the waist of the person, a protection apparatus that can be generally stated as including a number of cushion elements that are each structured to be movable from a configuration situated within a cavity of the number of cavities to another configuration situated at least partially outside the cavity and in protective proximity to a body part of the person, a control apparatus that can be generally stated as including a number of sensors that are structured to output a number of sensor signals, the control apparatus being structured to generate a trigger signal that is responsive to a detection of an initiation of a falling event of the person and that is based at least in part upon the number of sensor signal, an expansion apparatus which, responsive to the trigger signal, is structured to expand at least a first cushion element of the number of cushion elements from the configuration to the another configuration, and a notification apparatus that can be generally stated as including a storage, the notification apparatus being structured to periodically store in the storage data that is based upon at least a portion of the number of sensor signals and in so doing to periodically overwrite portions of the storage with the data, responsive to the trigger signal, the notification apparatus being structured to resist overwriting of a portion of the storage having stored therein a subset of the data, the subset of the data being based upon the at least portion of the number of sensor signals from a predetermined time prior to the detection of the initiation of the falling event through at least the detection of the initiation of the falling event.

Other aspects of the disclosed and claimed concept are provided by an improved belt apparatus structured to support on a person a trousers having a number of belt loops that are situated on an exterior surface of the trousers. The belt apparatus can be generally stated as including a trouser support apparatus that can be generally stated as including an elongated and flexible belt element having a number of cavities formed therein, the belt element being structured to be received in the number of belt loops of the trousers to thereby assist in supporting the trousers at the waist of the person, a protection apparatus that can be generally stated as including a number of cushion elements that are each structured to be movable from a configuration situated within a cavity of the number of cavities to another configuration situated at least partially outside the cavity and in protective proximity to a body part of the person, a control apparatus that can be generally stated as including a number of sensors that are structured to output a number of sensor signals, the control apparatus being structured to determine from the number of sensor signals an acceleration of the person and an angular velocity of the person, the control apparatus being structured to generate a trigger signal that is responsive to a detection of an initiation of a falling event of the person and that is based at least in part upon at least one of the acceleration exceeding a predetermined acceleration value and the angular velocity exceeding a predetermined angular velocity value, and an expansion apparatus which, responsive to the trigger signal, is structured to expand at least a first cushion element of the number of cushion elements from the configuration to the another configuration.

Other aspects of the disclosed and claimed concept are provided by an improved belt apparatus structured to support on a person a trousers having a number of belt loops that are situated on an exterior surface of the trousers. The belt apparatus can be generally stated as including a trouser support apparatus that can be generally stated as including an elongated and flexible belt element having a number of cavities formed therein, the belt element being structured to be received in the number of belt loops of the trousers to thereby assist in supporting the trousers at the waist of the person, a safety system switchable between a first state and second state and that can be generally stated as including a protection apparatus, a control apparatus, and an expansion apparatus, the trouser support apparatus further can be generally stated as including a fastener structured to be cooperable with the belt element to retain the belt element at a selected circumferential length, the fastener that can be generally stated as including an arming system that is structured to switch the safety system between the first and second states, the arming system placing the safety system in the first state when the fastener is cooperated with the belt element to retain the belt element at the selected circumferential length, the protection apparatus can be generally stated as including a number of cushion elements which, in the first state, are each structured to be movable from a configuration situated within a cavity of the number of cavities to another configuration situated at least partially outside the cavity and in protective proximity to a body part of the person, the control apparatus can be generally stated as including a number of sensors and being structured, in the first state, to generate a trigger signal responsive to a detection of an initiation of a falling event of the person, and the expansion apparatus being structured to expand at least a first cushion element of the number of cushion elements from the configuration to the another configuration in the first state and responsive to the trigger signal.

Other aspects of the disclosed and claimed concept are provided by an improved belt apparatus structured to support on a person a trousers having a number of belt loops that are situated on an exterior surface of the trousers. The belt apparatus can be generally stated as including a trouser support apparatus that can be generally stated as including an elongated and flexible belt element having a number of cavities formed therein, the belt element being structured to be received in the number of belt loops of the trousers to thereby assist in supporting the trousers at the waist of the person, the trouser support apparatus further can be generally stated as including a fastener affixed to the belt element and structured to be cooperable with the belt element to retain the belt element at a selected circumferential length, the fastener being structured to be removed from the belt element and to be affixed to another belt element, a protection apparatus situated on the belt element and that can be generally stated as including a number of cushion elements which are each structured to be movable from a configuration situated within a cavity of the number of cavities to another configuration situated at least partially outside the cavity and in protective proximity to a body part of the person, a control apparatus which can be generally stated as including a number of sensors that are situated on the fastener, the control apparatus being structured to generate a trigger signal responsive to a detection of an initiation of a falling event of the person, and an expansion apparatus situated on the belt element and which, responsive to the trigger signal, is structured to expand at least a first cushion element of the number of cushion elements from the configuration to the another configuration.

Other aspects of the disclosed and claimed concept are provided by an improved kit structured to be cooperable with a trousers having a number of belt loops that are situated on an exterior surface of the trousers. The kit can be generally stated as including a plurality of belt elements that are each elongated and flexible, each belt element of the plurality of belt elements having a number of cavities formed therein, each belt element of the plurality of belt elements further can be generally stated as including a protection apparatus and an expansion apparatus, a fastener that can be generally stated as including a control apparatus and being structured to be alternatively affixed together with each belt element of the plurality of belt elements, the fastener and a particular belt element of the plurality of belt elements that are affixed together forming a belt apparatus, the fastener structured to be cooperable with the particular belt element to retain the particular belt element at a selected circumferential length, the particular belt element being structured to be received in the number of belt loops of the trousers to thereby assist in supporting the trousers at the waist of a person, the protection apparatus can be generally stated as including a number of cushion elements which are each structured to be movable from a configuration situated within a cavity of the number of cavities to another configuration situated at least partially outside the cavity and in protective proximity to a body part of the person, the control apparatus can be generally stated as including a number of sensors and being structured to generate a trigger signal responsive to a detection of an initiation of a falling event of the person; and the expansion apparatus being structured to expand at least a first cushion element of the number of cushion elements from the configuration to the another configuration responsive to the trigger signal.

BRIEF DESCRIPTION OF THE DRAWINGS

A further understanding of the disclosed and claimed concept can be gained from the following Description when read in conjunction with the accompany drawings in which:

Similar numerals refer to similar parts throughout the specification.

DESCRIPTION

Figure 1:
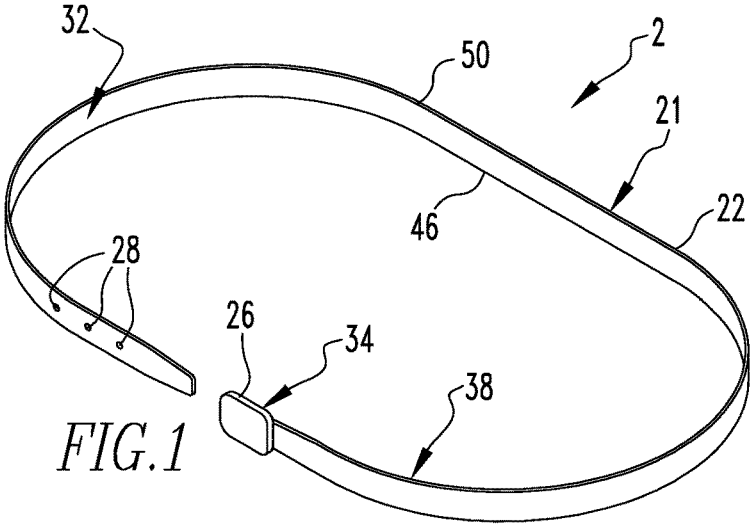
FIG. 1 is a schematic view of an improved belt apparatus in accordance with a first embodiment of the disclosed and claimed concept.
Figure 2:
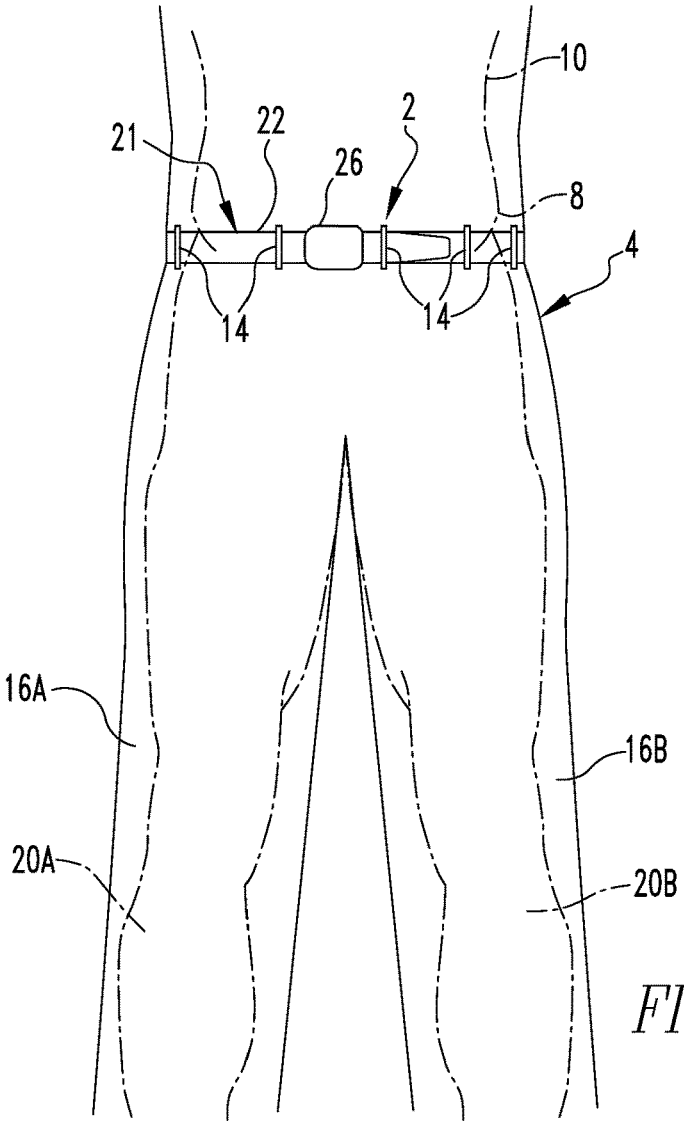
FIG. 2 is a schematic depiction of the belt apparatus of FIG. 1 during ordinary use supporting a pair of trousers at generally the waist of a person.

An improved belt apparatus 2 in accordance with a first embodiment of the disclosed and claimed concept is depicted generally in FIGS. 1-3, and 7-8. The belt apparatus 2 has the appearance and function of a conventional apparel belt or trouser belt but, as will be set forth in greater detail below, is advantageously configured to protect a person from injury as a result of a falling event.

The belt apparatus 2 is configured to support a pair of trousers 4 at approximately the waist 8 of a person 10. The trousers 4 can be conventional items of apparel and can be of any length. The exemplary depicted trousers 4 include a plurality of belt loops 14 and a pair of pant legs 16A and 16B that are intended to clothe a pair of legs 20A and 20B of the person 10. In a conventional fashion, the belt apparatus 2 is received in the belt loops 14 and is fastenable with itself at a selected circumferential length to retain the trousers 4 at the waist 8 of the person 10.

Figure 3:
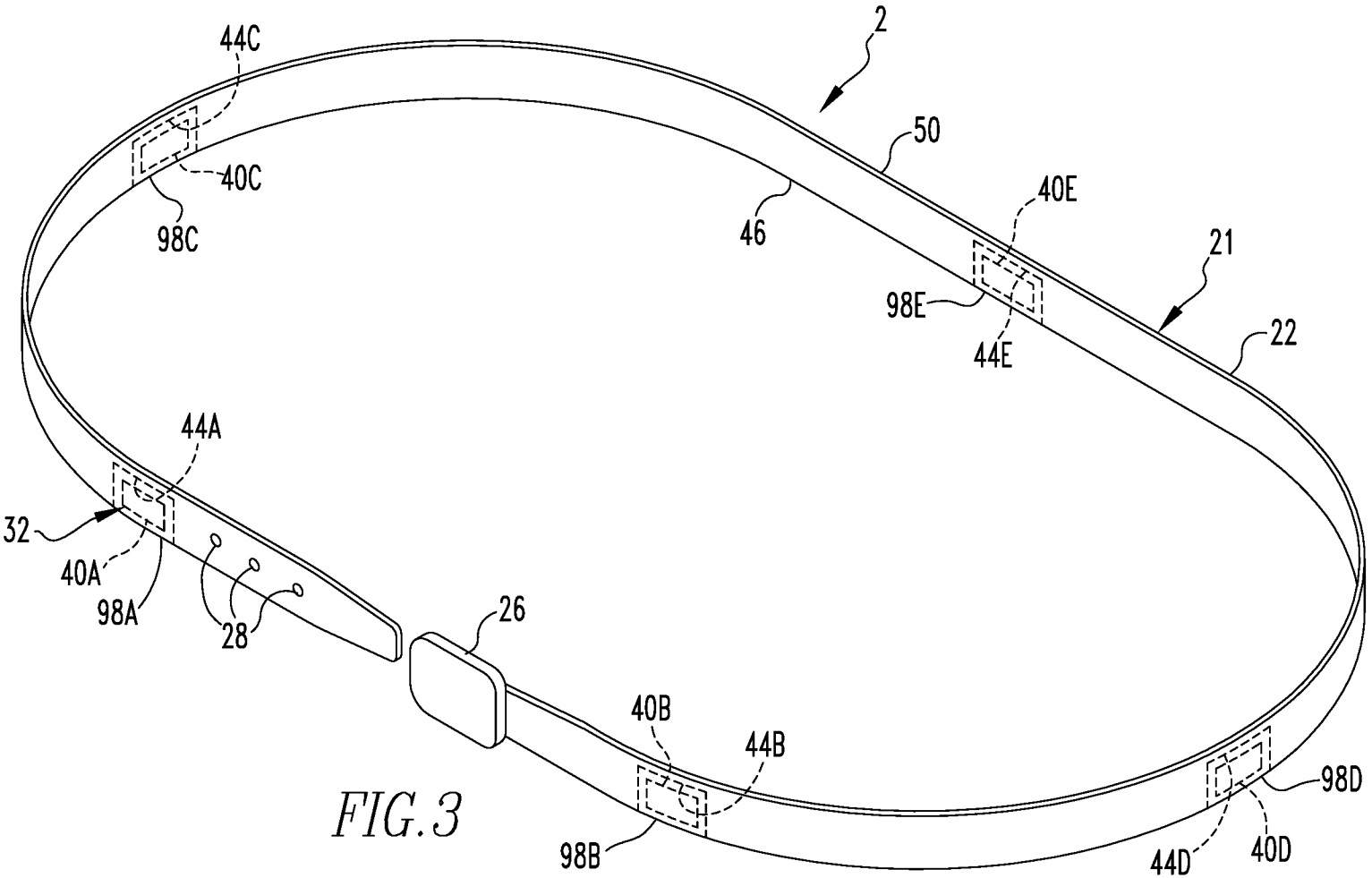
FIG. 3 is another view of the belt apparatus of FIG. 1.

As can be understood from FIGS. 1 and 3, the belt apparatus 2 includes trouser support apparatus 21 that can be said to include an elongated and flexible belt element 22 and a fastener 26. The fastener 26 is situated at one of the belt element 22 and is in the exemplary form of a buckle. The belt element 22 can be formed of any of a wide variety of materials such as leather, canvas, or webbing material, such as in the fashion of a conventional trousers belt and which, in the depicted exemplary embodiment, has a number of holes 28 formed therein in the vicinity of an end of the belt element 22 that is opposite the end where the buckle 26 is situated. As employed herein, the expression "a number of" and variations thereof shall refer generally to any non-zero quantity, including a quantity of one. The exemplary buckle 26 is one having a base and fixed post (not expressly shown herein) protruding therefrom that is receivable in one of the holes 28 to retain the belt apparatus 2 and particularly the belt element 22 at a selected circumferential length. It is noted, however, that the belt element 22 and the buckle 26 can be in any of a variety of configurations and can interact with one another in the fashion of any of variety of known conventional trouser belts that are used as apparel without limitation. The belt apparatus 2 is advantageously configured to be usable by the person 10 in essentially exactly the same way as a conventional trouser belt, with the result that the person 10 can be protected from bone breakage in a falling event without having to make any special efforts or take any special actions other than installing the belt apparatus 2 on the trousers 4 in virtually the same way that the person 10 would employ a conventional apparel belt to support the trousers 4.

The belt apparatus 2 additionally includes a protection apparatus 32, a control apparatus 34, and an expansion apparatus 38 that are situated on the trouser support apparatus 21 and that are cooperable to protect the person from injury as a result of a falling event. That is, such apparatuses are cooperable such that, during a falling event, skeletal injuries are advantageously reduced or avoided completely.

Figure 8:
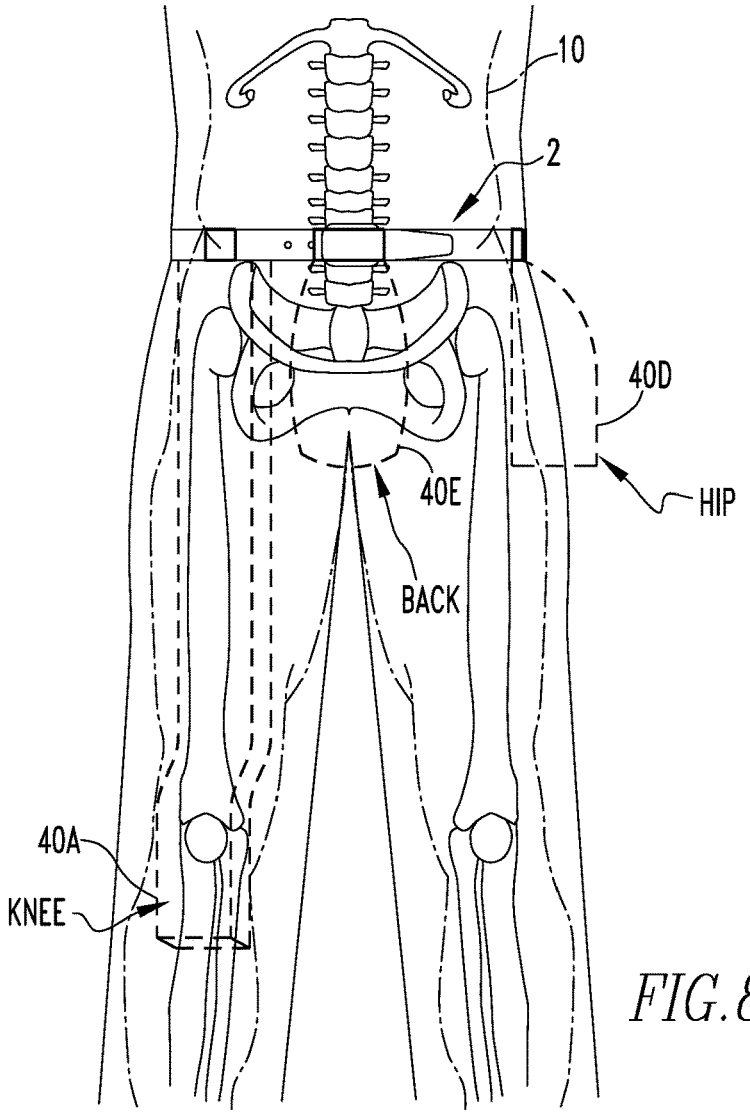
FIG. 8 is a view similar to FIG. 7, except depicting a front elevational view of the belt apparatus and further depicting in dashes lines some of the airbags of the belt apparatus in an expanded configuration.

The protection apparatus 32 includes a plurality of cushion elements 40A, 40B, 40C, 40D, and 40E (collectively referred to herein with the numeral 40) which, in the depicted exemplary embodiment, are embedded within the belt element 22, as is shown in FIG. 3, and are individually expandable by the expansion apparatus 38 under the direction of the control apparatus 34. The cushion elements 40 are depicted in FIG. 3 as being in a collapsed configuration wherein they are each situated substantially entirely within the belt element 22. The cushion elements 40 are generally in the exemplary form of airbags that are expandable by the expansion apparatus 38 from the collapsed configuration depicted generally in FIG. 3 to an expanded condition protruding to the exterior of the belt element 22 and being shaped as is indicated generally in FIG. 8. That is, FIG. 8 generally depicts in dashed lines the cushion elements 40A, 40D, and 40E as each being in their expanded configuration, although in use, as will become apparent, the belt apparatus 2 is unlikely to simultaneously deploy the cushion elements 40A, 40D, and 40E. It is thus understood that FIG. 8 is intended primarily to illustrate the positioning and shapes of the various cushion elements 40 in their expanded configurations.

Figure 4A:
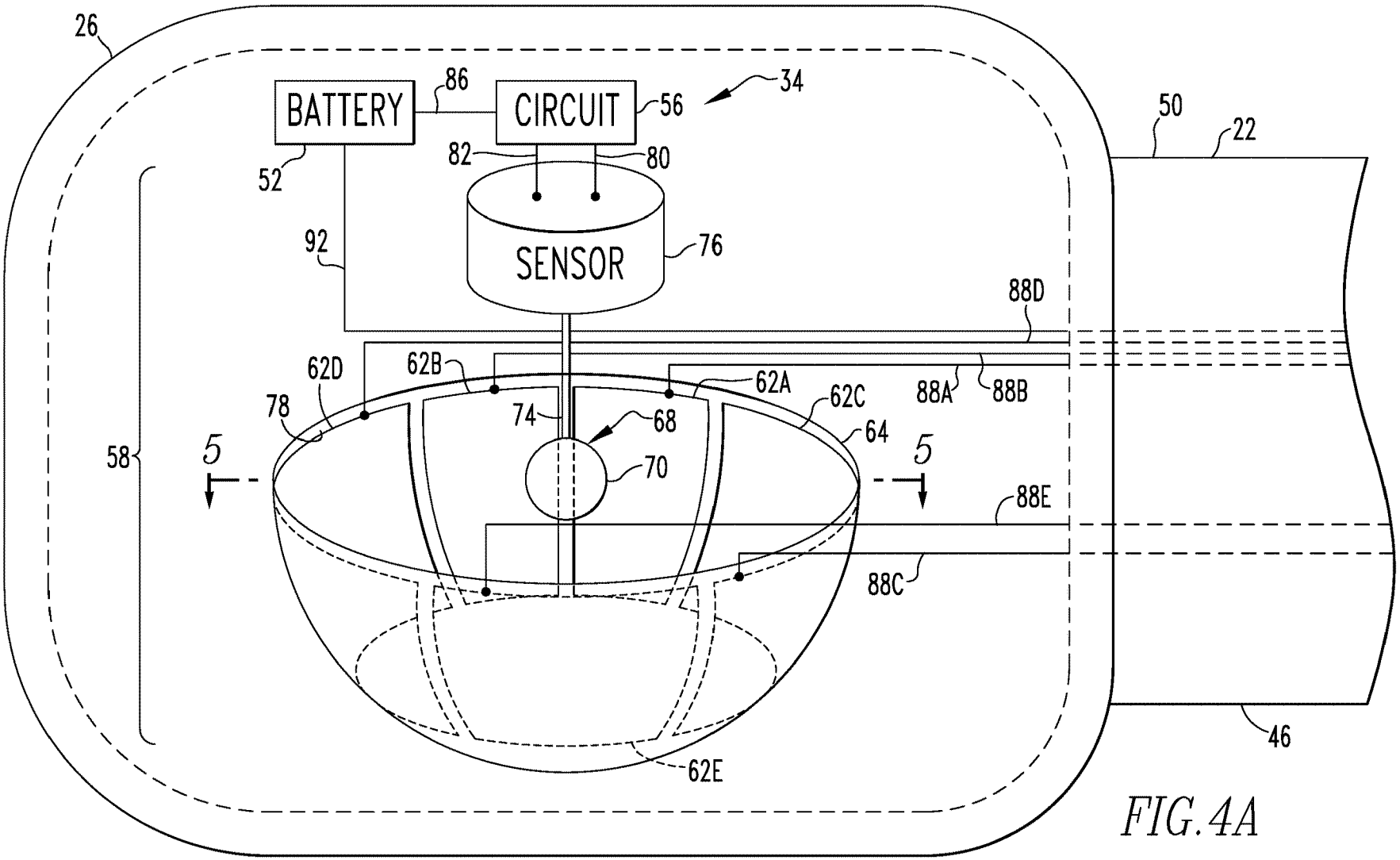
FIG. 4A is a view, partially cut away, of the improved belt apparatus of FIG. 1.
Figure 4B:
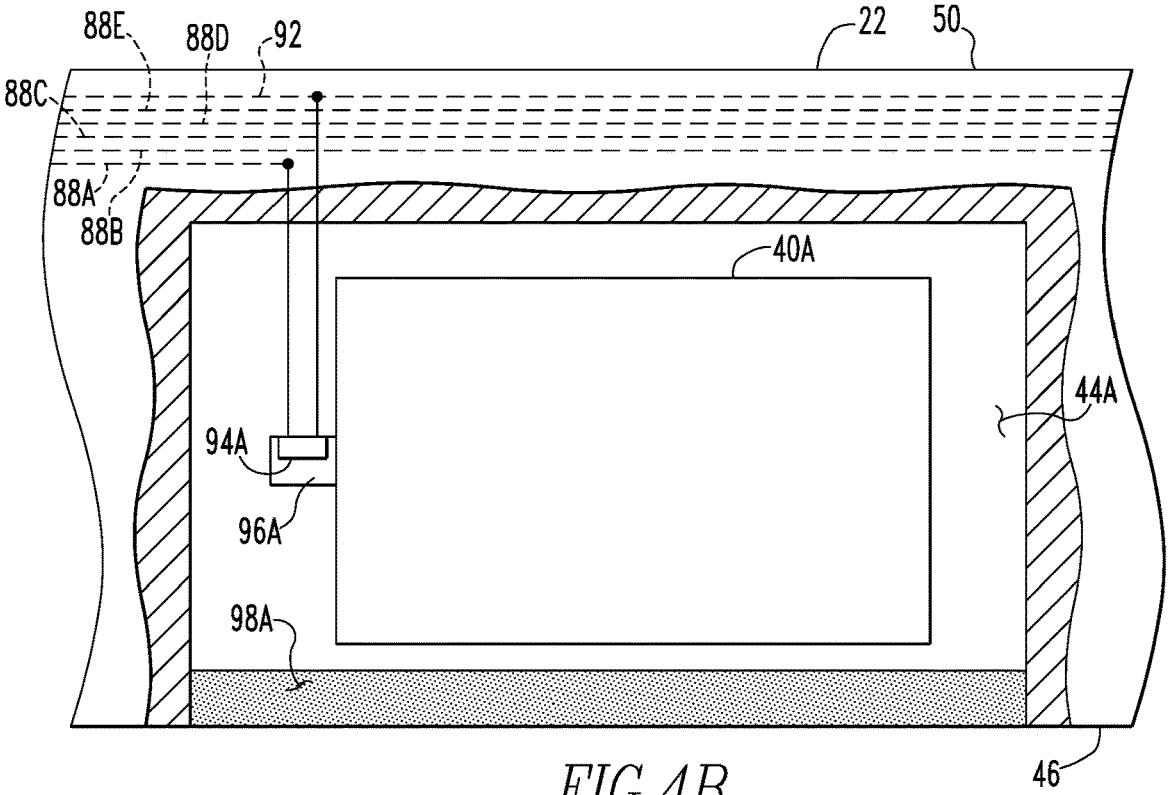
FIG. 4B is a schematic view, partially cutaway, of another portion of the belt apparatus of FIG. 1

As can be understood from FIGS. 3 and 4B, the belt element 22 has a plurality of cavities 44A, 44B, 44C, 44D, and 44E (collectively referred to herein with the numeral 44) formed therein within which the cushion elements 40 are disposed. The belt apparatus 2 can be further said to have an elongated first edge and an elongated second edge 50 opposite one another on the belt element 22. In use, and as can be understood generally from FIG. 8, the first edge 46 is a lower edge of the belt element 22, and the second edge 50 is an upper edge of the belt element 22, both being from the perspective of FIG. 8. The belt element 22 has a length that is significantly greater than its width, i.e., the distance between the first and second edges 46 and 50, and the width is likewise significantly greater than the thickness of the belt element 22 as is depicted generally in FIG. 4C. The cavities 44 are configured such that they retain the cushion elements 40 situated therein in the collapsed configuration without the cushion elements 40 meaningfully affecting the flexibility of the belt element 22, whereby the belt element 22 and the buckle 26 appear to the person 10 and are usable thereby in substantially exactly the same fashion as an ordinary apparel belt of the type that is generally known for retaining trousers at the waist of a person.

In the depicted exemplary embodiment, the control apparatus 34 is situated generally on the buckle 26, and the expansion apparatus 38 is situated generally on the belt element 22. It is understood, however, that different arrangements of the elements described herein can be employed without departing from the present concept.

As can be understood generally from FIG. 4A, the control apparatus 34 can be said to include a power source 52 which in the exemplary embodiment depicted herein is in the form of a small battery of conventional chemistry. The control apparatus 34 further includes a control circuit 56 and a plurality of fall-detection elements 58 that are cooperable with the control circuit 56. The exemplary fall-detection elements 58 include a plurality of contacts 62A, 62B, 62C, 62D, and 62E (collectively referred to herein with the numeral 62) that are situated on a support 64 and further include a pendulum 68 having a mass 70 that is situated at a free end of a flexible support element 74. The number of fall-detection elements 58 can further be said to include a sensor 76 that is connected with the control circuit 56.

The support 64 is generally of a hollow semi-spherical shape having an inner surface 78 that is likewise of a semi-spherical shape. It the contacts 62 are thus each of a partially spherical shape. The contacts 62 are each electronically connected with elements of the expansion apparatus 32 and are operatively connected with the cushion elements 40 to enable them to move from their collapsed configuration to their expanded configuration, as will be set forth in greater detail below.

The mass 70 of the pendulum 68 is a conductive element, i.e. conductive on at least its exterior surface, and is movable about the interior region of the support 64 (which is generally bounded by the contacts 62) while being suspended from the support element 74. In the depicted exemplary embodiment, the support element 74 is likewise electrically conductive and is electrically connected with the mass 70 and is further electrically connected with the control circuit 56 via a lead 80. The sensor 76 is electronically connected with the control circuit 56 via another lead 82, and the power source 52 is electrically connected with the control circuit 56 via a further lead 86. Each contact 62A, 62B, 62C, 62D, and 62E is electrically connected with one of a plurality of leads 88A, 88B, 88C, 88D, and 88E (collectively referred to herein with the numeral 88), respectively. An additional lead 92 is connected with the ground terminal of the power source 52.

The sensor 76 is structured to detect a velocity and/or an acceleration of the mass 70 and/or the support element 74, and such velocity and acceleration can be linear or angular or both. In one exemplary embodiment, the sensor 76 detects the angular velocity of the support element 74 with respect to the sensor 76, and such angular velocity can be referred to with the designation $d\theta/dt$. The sensor 76 can be any of a variety of sensing devices such as accelerometers, optical sensors, eddy current sensors, and the like without limitation. Moreover, the sensor 76 can detect the aforementioned velocity and/or acceleration, linear and/or angular, in any of a variety of fashions. In this regard, and by way of example, it is understood that the sensor 76 might detect the position of the support element 74 or the position of the mass 70 or both as a function of time and from which velocities and accelerations, both linear and angular, can be derived. It thus can be said that the sensor 76 outputs to the control circuit 56 a movement signal that is representative of a velocity or an acceleration or both of the mass 70 and/or the support element 74, it being understood that the actual determination of the velocity and/or acceleration might be calculated by the control circuit 56 itself rather than by the sensor 76.

During ordinary use of the belt apparatus 2, meaning during wearing of the belt apparatus 2 by the person 10, the mass 70 remains suspended on the support element 74 and freely moves about within the interior of the support 64 and potentially comes into electrical engagement with one or more of the contacts 62. Such electrical engagement between the mass 70 and one or more of the contacts 62 does not necessarily cause any other actions to occur on the belt apparatus 2. This is because the control circuit 56 is advantageously configured to ignore daily occurrences that are not falling events. For example, a person may move from a standing position to a sitting position, and the $d\theta/dt$ of such an event is less than that which would indicate a falling event. The control circuit 56 effectively ignores such events as being indicative of false alarms, i.e., occurrences that appear to share some characteristics with a fall but that are not falling events. Other types of occurrences that are ignored as false alarms would include riding on an amusement park ride such as a roller coaster, driving in an automobile over a bumpy road, shooting a firearm, etc. In this regard, the control circuit 56 may employ logic that includes representations of a number of predetermined events, such as those set forth in the preceding sentence, which are automatically ignored as false alarms.

However, if the signal from the sensor 76 is interpreted by the control circuit 56 to be indicative of an initiation of a falling event, the control circuit 56 generates a triggering signal which is communicated to the mass 70 through the lead 80 and the support element 74. When the mass 70 electrically engages one of the contacts 62, the triggering signal is communicated through the engaged contact 62 and is further communicated therefrom as a directional triggering signal along the lead 88 that is connected with the engaged contact 62.

Figure 6:
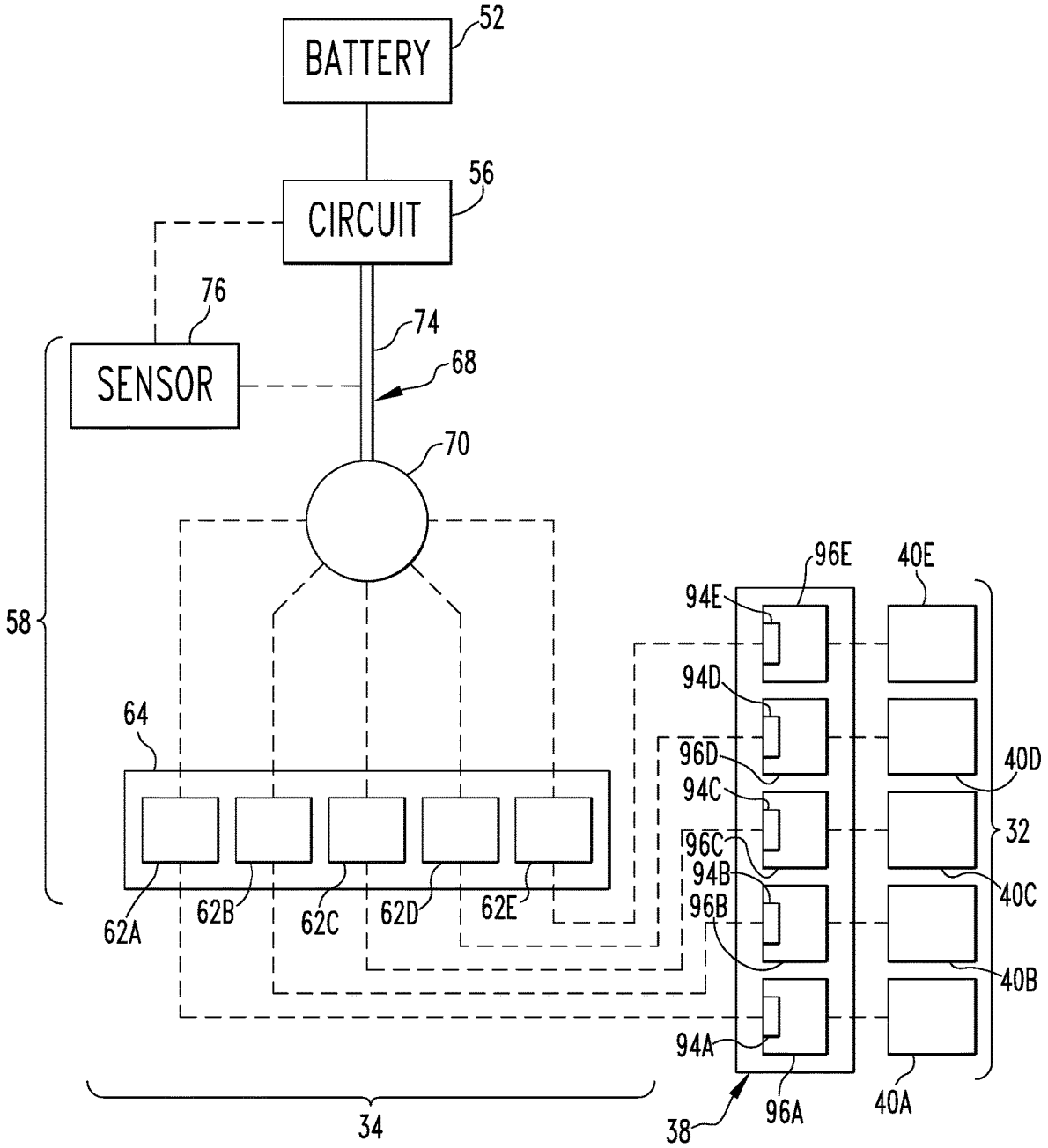
FIG. 6 is a schematic depiction of portions of a control apparatus of the belt apparatus of FIG. 1.

As can be understood from FIG. 6, the expansion apparatus 38 includes a plurality of igniters 94A, 94B, 94C, 94D, and 94E (collectively referred to herein with the numeral 94) that are configured to ignite separate amounts of propellant 96A, 96B, 96C, 96D, and 96E (collectively referred to herein at the numeral 96). The exemplary propellant 96 employed herein is sodium azide ($NaN_3$) which, when ignited by one of the igniters 94, rapidly generates a large volume of nitrogen gas ($N_2$) that is used to move a corresponding cushion element 40 from its collapsed configuration to its expanded configuration, such as in the fashion of an automobile airbag. When the directional triggering signal is communicated along one of the leads 88 to a corresponding igniter 94, it ignites the associated charge of propellant 96.

Figure 4C:
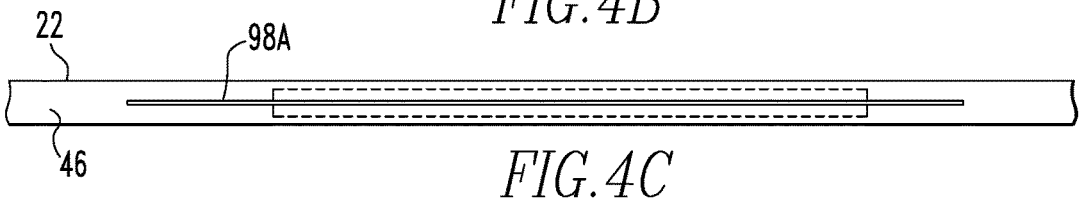
FIG. 4C is a view from another perspective of the portion of the belt depicted generally in FIG. 4B.

The cushion elements 40 are each in the form of generally enclosed bags that either have the propellant 96 situated therein or that have an opening through which the nitrogen gas generated by the propellant 96 can be introduced into the interior of the cushion element 40. As such, the nitrogen gas that is rapidly generated by the propellant 96 expands the corresponding cushion element 40 from the collapsed configuration to the expanded configuration with explosive force. The belt element 22 thus is formed to include a plurality of frangible regions 98A, 98B, 98C, 98D, and 98E (indicated schematically in FIG. 3 and collectively referred to herein with the numeral 98) that are situated generally at the first edge 46 and extend at least slightly into the interior of the belt element 22, as can be seen more particularly with the frangible region 98A in FIG. 4B. The frangible regions 98 are generally closed when the cushion elements 40 are in their collapsed configuration, as can be seen in FIG. 4C, and such frangible regions 98 can be retained in such a closed condition through the use of adhesives, fastening structures, or in any of a wide variety of understood fashions. Upon ignition of the charge of propellant 96 associated with any cushion element 40, the nitrogen gas that is generated by the propellant 96 expands the associated cushion element 40 with explosive force which causes the associated frangible region 98 to break or otherwise separate, which thereby permits the cushion element 40 to protrude out of the frangible region 98 to the exterior of the belt element 22 in protective proximity with a portion of the body of the person 10. It thus can be understood that the control apparatus 34 is configured to detect that a falling event is occurring in a particular direction with respect to the person 10 and is further configured to generate a directional trigger signal which causes the expansion apparatus 38 to deploy at least one cushion element 40 that is situated in the particular direction with respect to the person 10. This desirably interposes the deployed cushion element 40 between a body part of the person 10 and another object such as a floor, a wall, or another object.

The cushion elements 40 are desirably rapidly expanded, i.e., inflated by the nitrogen gas from the ignited propellant 96, but are also desirably deflated promptly thereafter in order to avoid the person 10 rebounding from the expanded cushion element 40. That is, the expanded cushion element 40 advantageously absorbs some of the energy of the fall, thereby allowing the person 10 to contact the floor, the wall, etc. with far less energy than would occur in the absence of the belt apparatus 2. The fall is desirably of sufficiently low energy that the breakage of bones is avoided. The deflation of the cushion element 40 is thus intended to dissipate the absorbed energy to thereby avoid the cushion element acting like a spring and redirecting any energy that has been absorbed back into the person 10, which might cause the person to fall in another direction with the same energy or which might itself cause a bone breakage if such energy is not dissipated. The cushion elements 40 are thus advantageously formed of 6-6 nylon that is woven in a fashion that it is reactive to the explosive expansion of the gases generated by the propellant 96 but that have sufficient spacing among the fibers thereof to permit the gas to escape through the interstices of the fabric of the cushion element 40, such as in the fashion of an automobile airbag.

Figure 7:
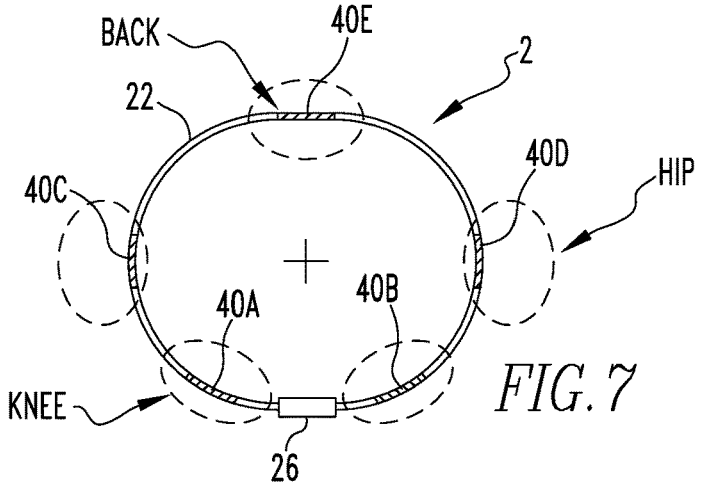
FIG. 7 is a schematic top plan view of the belt apparatus of FIG. 1 as it would be situated on the person, as in FIG. 2.

The positioning and configuration of the various cushion elements 40 is depicted generally in FIGS. 7 and 8. The cushion element 40A is intended to protect the right knee of the person and is depicted in an expanded configuration in FIG. 8A. The cushion element 40B is a mirror image of the cushion element 40A and is intended to protect the left knee of a person. When the belt apparatus 2 is worn by the person 10, the cushion elements 40A and 40B are situated generally anterior to the person 10. As can be understood generally from FIG. 8, the cushion elements 40A and 40B can each be said to include a first elongated region which, when expanded, is intended to extend from the belt apparatus 2 and along the femur toward the knee. The cushion elements 40A and 40B each further have a second elongated region distal to the first elongated region that is offset from the first elongated region and is intended to be in protective proximity of the knee.

The cushion elements 40C and 40D are relatively wider than the cushion elements 40A and 40B and are intended to protect the right and left hips, respectively, of the person 10. The cushion element 40D is depicted generally in FIG. 8 in its expanded configuration. The cushion element 40C in its expanded configuration is a mirror image of cushion element 40D. In use, the cushion elements 40C and 40D are situated generally laterally with respect to the person 10. The relatively shorter but wider configuration of the cushion elements 40C and 40D when compared with the cushion elements 40A and 40B enables the cushion elements 40C and 40D to protect, for instance, the right and left pelvic arches, respectively, during a falling event.

The cushion element 40E is generally rectangular in shape and is intended to protect the pelvis and lower spine, as is indicated in FIG. 8. The cushion element 40E is thus situated at the posterior of the person 10 when the belt apparatus 2 is worn by the person 10.

While the cushion elements 40 are described herein as each being extendable (in the expanded configuration) through a corresponding frangible region 98 situated at the first edge 46, it is understood that the cushion elements 40 can extend through other types of frangible regions or may be otherwise retained on the belt element 22 while still providing the protective proximity to the various body parts described above. Moreover, the exemplary depicted cushion elements 40 or other types of cushion elements that are intended to protect other parts of the body can extend from other portions of the belt element 22. For example, an additional cushion element might be configured to expand in a direction opposite the direction of expansion of the cushion element 40E and may be configured to protect the lumbar and thoracic spine of the person 10, by way of example. Other types of cushion elements can be envisioned.

As set forth above, the cushion elements 40 are each configured to be inflated rapidly. Upon ignition of the propellant 96, the gases generated thereby can cause the related cushion elements 40 to expand nearly instantaneously. Since the cushion elements 40 also desirably deflate promptly after expansion, the ignition of the propellant 96 is desirably timed to coincide with roughly the time at which the person 10 is about the strike the ground or another object subsequent to the onset of the falling event. That is, acceleration due to gravity is a well understood concept, and is understood that the knees, hips, and pelvis of a person in the midst of a falling event typically fall toward the ground at velocities slower than would be experienced purely due to gravity since the knees, hips, and pelvis of the person 10 most typically move about other body structures during the falling event. That is, the knee is situated atop the tibia and fibula of the person and these bones are situated atop the ankle of the person. During a fall, the tibia and fibula typically will pivot at least somewhat about the ankle or at least with respect to the ground. The hips and pelvis are situated atop the femurs of the person and likewise pivot about the ankle and potentially the knee during a falling event.

The result is that the knees, hips, and pelvis of the person move toward the ground during a falling event at velocities that are less than that which would ordinarily result purely from the acceleration due to gravity. Since the ignition of the propellant 96 causes the corresponding cushion elements 40 to expand nearly instantaneously, the ignition of the propellant 96 is desirably timed, i.e., delayed, so that the cushion element 40 is expanded into protective proximity with the protected body part just prior to the time at which the protected body part would otherwise strike the ground. This is done in order to enable the protected body part to experience the maximum protection afforded by the expanding cushion element 40, which would occur generally at the point where the cushion element 40 reaches a state of complete expansion and just prior to the point at which the expansion of gases from the propellant 96 ceases and the cushion element 40 begins to deflate.

The control apparatus 34 thus delays the outputting of the trigger signal by a short period of time that is intended to cause the expansion of the cushion elements 40 to be at their aforementioned maximum protective capability immediately prior to the person striking, for instance, the ground. In the depicted exemplary embodiment, the trigger signal is output from the control apparatus 34 as a delayed trigger signal which is timed to cause the one or more cushion elements 40 that are in the direction of the falling event to be completely expanded at approximately 0.03 seconds after the initiation of the falling event. Such a delay may be adjusted depending upon the perceived velocity of the falling event which can be derived from the aforementioned $d\theta/dt$ signal obtained from the sensor 76, although other indicators and/or data can be employed to determine the amount of delay needed for a particular falling event. The delay in the generation of the delayed trigger signal is desirably timed such that the following action are accomplished immediately prior to the body part striking, for instance, the ground: the control circuit 56 generates the directional trigger signal, which is communicated to the corresponding igniter 94, which ignites its associated propellant 96, which expands the corresponding cushion element 40, which breaks the associated frangible region 98, and which expands into protective proximity of the protected body part. The exemplary total time is described as being approximately 0.03 seconds. Since the delayed trigger signal generated by the control circuit 56 is communicated at substantially the speed of light to the corresponding igniter 94, it can be understood that the time required for ignition of the propellant 96 and expansion of the corresponding cushion element 40 is a significant factor in determining the appropriate delay.

Figure 5:
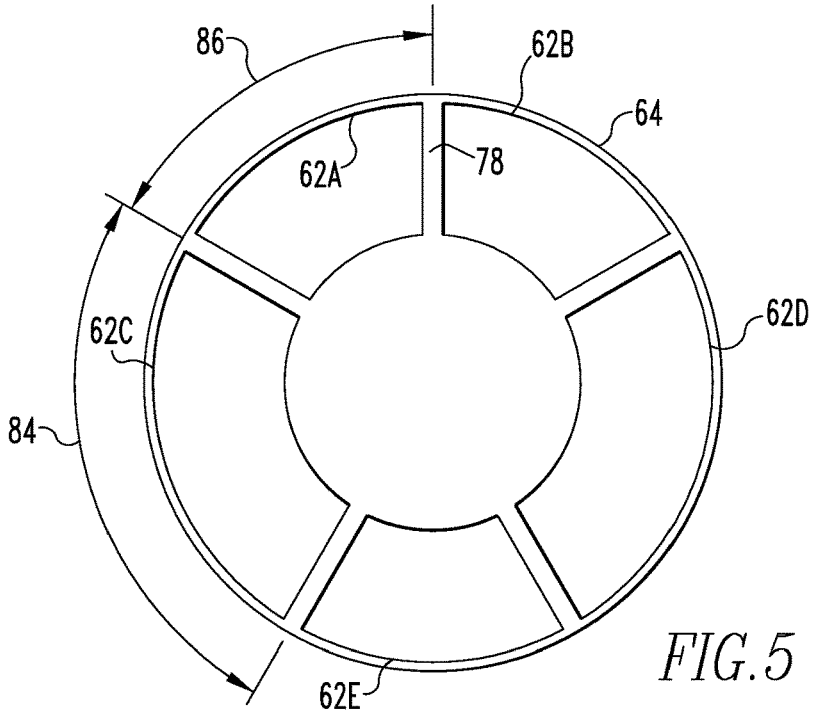
FIG. 5 is a sectional view as taken along line 5-5 of FIG. 4A.

As can be understood from FIGS. 4A and 5, the various contacts 62 are positioned about the support 64 in such a fashion that each contact 62 will be contacted by the mass 70 depending upon the direction of the falling event with respect to the person. The spaces between adjacent contacts 62 are exaggerated herein, and it is therefore understood that a given falling event may be in such a direction that the mass 70 electrically engages two of the contacts 62 that are adjacent one another, in which case the two corresponding cushion elements 40 will be expanded into protective proximity with their protected body parts. In this regard, the mass 70 may itself be somewhat flexible or may contain conductive structures that facilitate the contacting of more than one contact 62 by the mass 70 in order to provide a greater degree of protection to the person 10.

As can further be seen from FIG. 5, the contacts 62 need not each occupy an equal portion of the perimeter of the support 64. By way of example, the contacts 62C and 62D, which protect the hips of the person 10, may occupy a relatively larger portion (as indicated at the numeral 84 in FIG. 5) of the perimeter of the support 64 than the contacts 62A and 62B (as indicated at the numeral 86 in FIG. 5) and the contact 62E. This may be desirable due to, for example, the potential to break the hips from a large range of directions with respect to the person 10. Other configurations of the contacts 62 will be apparent.

It thus can be seen that the improved belt apparatus 2 is advantageously configured to appear and function during ordinary use in a fashion that is generally indistinguishable from an ordinary trouser belt, which encourages a person to regularly wear the belt apparatus 2 since no additional thought is required beyond the thought that is necessary in putting on and wearing an ordinary belt. The belt apparatus 2 is thus deployable to protect a person from injury due to bone breakage as a result of a fall.

It is noted that the belt loops 14 of the trousers 4 desirably might be configured to avoid interference with expansion of the various cushion elements 40. For example, the belt loops 14 might be positioned so that they do not overlap any of the cushion elements 40. Alternatively or additionally, the belt loops 14 may be configured with a relatively weak attachment at the point of connection with the trousers at the lower end, i.e., the end which would be adjacent the first edge 46 of the belt element 22. Still additionally or alternatively, the protection apparatus 32 and/or the expansion apparatus 38 may be configured such that the belt loops 14 simply serve as additional frangible elements that are intended to be torn or detached from the trousers 4 by the explosive power of the ignited propellant 96.

Figure 9:
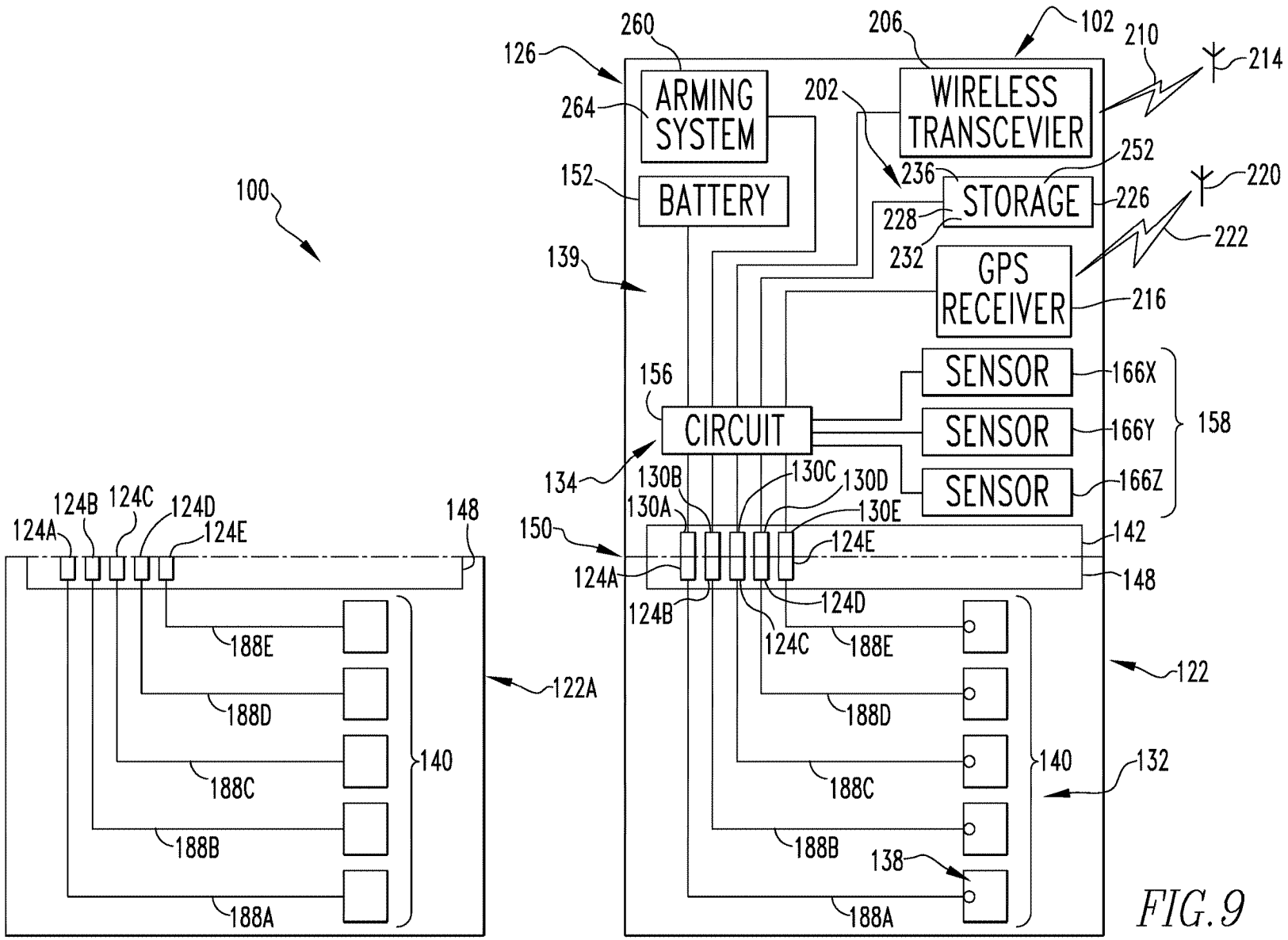
FIG. 9 is a schematic depiction of an improved belt apparatus in accordance with a second embodiment of the disclosed and claimed concept and a kit that is likewise in accordance with the disclosed and claimed concept and that includes the second embodiment.
Figure 10:
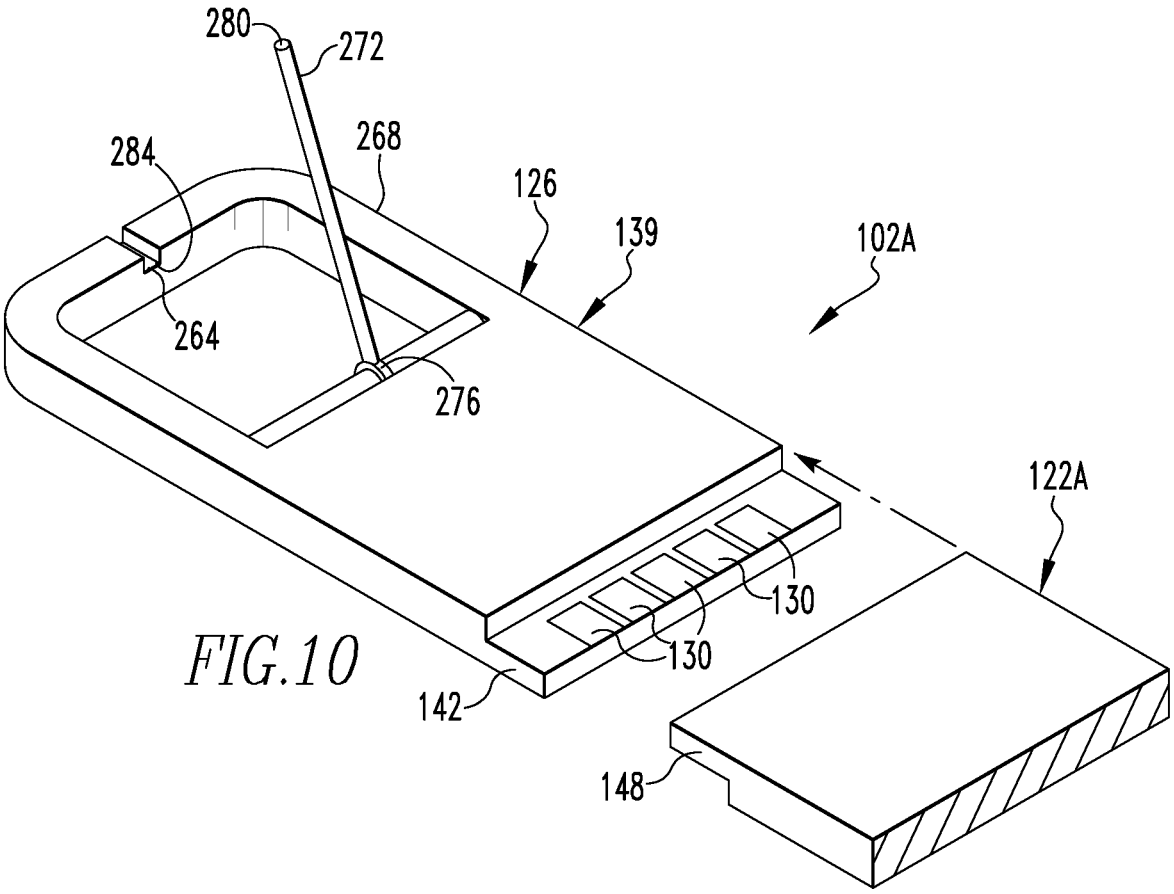
FIG. 10 is a depiction of the second embodiment with a fastener and a belt element thereof in a separated configuration and with a tang of the fastener spaced from a base of the fastener.
Figure 11:
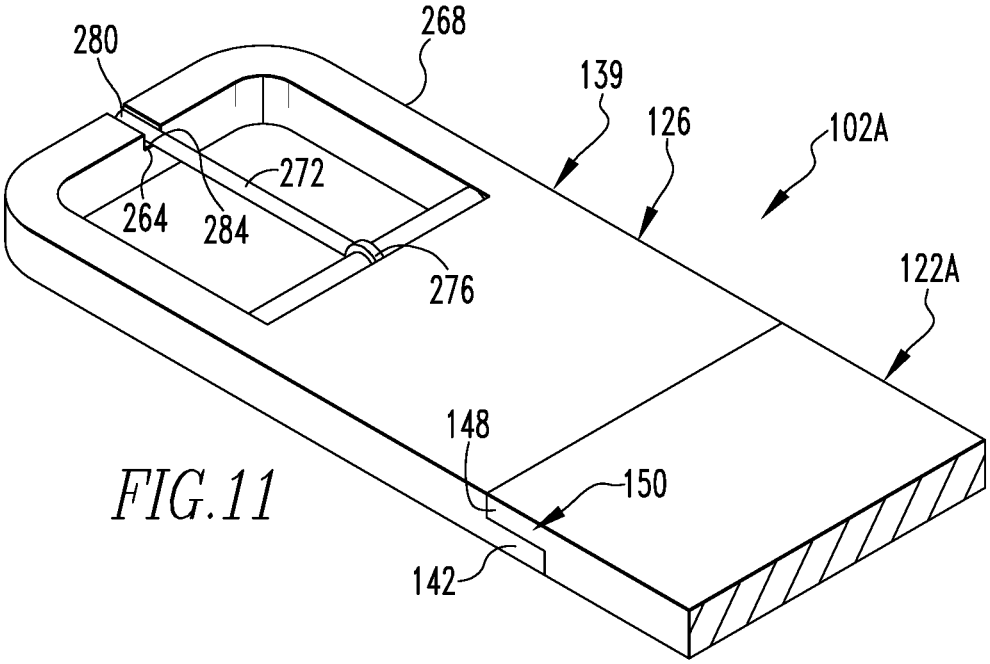
FIG. 11 is similar to FIG. 10, except depicting the fastener and belt element in an attached configuration and depicting the tang engaged with the fastener.

FIG. 9 schematically depicts an improved belt apparatus 102 in accordance with a second embodiment of the disclosed and claimed concept. Furthermore, FIG. 9 depicts the belt apparatus 102 as being a part of a kit 100 that is likewise in accordance with the disclosed and claimed concept. The belt apparatus 102 includes an elongated and flexible belt element 122 and a fastener that is in the exemplary form of a buckle 126 that are connectable together to form the belt apparatus 102. Advantageously, the kit 100 includes these components and additionally includes an alternate belt element 122A that is connectable with the buckle 126 in order to form an alternate belt apparatus 102A such as is depicted in FIGS. 10 and 11.

The belt apparatus 102 is similar to the belt apparatus 2, except that the belt apparatus 102 includes a different control apparatus 134 and some additional enhancements, any one or more of which can be incorporated into the belt apparatus 2 depending upon the needs of the particular application. The control apparatus 134 is still situated on the buckle 126 of the belt apparatus 102, and the belt element 122 extends from the buckle 126. However, while the control apparatus 134 can be said to include a control circuit 156 and a number of fall detection elements 158, the exemplary number of fall detection elements 158 of the belt apparatus 102 comprise a number of sensors 166X, 166Y, and 166Z (collectively or individually referred to herein with the numeral 166) which are each in the exemplary form of an accelerometer. That is, the sensors 166 might be accelerometers that are oriented orthogonal to one another, or they may be other types of sensors. Moreover, the sensors 166 need not necessarily be situated orthogonal to one another, and it is possible that a lesser quantity of accelerometers or other sensors can be oriented in various directions from which sufficient signals can be input to the control circuit 156 to enable the control circuit 156 to identify the onset of a falling event.

The control circuit 156 likewise provides a delayed trigger signal that is timed to coincide with a moment just prior to the person striking, for example, the ground, and the trigger signal is moreover a directional trigger signal which causes expansion of one or more of a plurality of cushion elements 140A, 140B, 140C, 140D, and 140E (collectively or individually referred to herein with the numeral 140). The cushion elements 140 are connected with the control circuit 156 via a number of contacts that are described in greater detail elsewhere herein and a number of directional trigger connections which, in the depicted exemplary embodiment, include a plurality of leads 188A, 188B, 188C, 188D, and 188E (collectively or individually referred to herein with the numeral 188) that are each connected with a corresponding one of the cushion elements 140.

It is understood, however, that the connections between the control circuit 156 and the various cushion elements 140 could be provided other than through the use of the individual dedicated leads 188. For example and depending upon the capability of the power source 152, it may be possible to provide a wired or wireless network which may or may not continually communicate signals between the control circuit 156 and the cushion elements 140 to cause one or more particular cushion elements 140 to be expanded in response to a detection of a falling event. For instance, the control circuit 156 might additionally include an RF transmitter that communicates a delayed and directional trigger signal to a particular receiver associated with a particular cushion element 140 to cause the particular cushion element 140 to expand in response to a falling event. By way of further example, instead of providing individual wires or leads that extend along the belt element 122 between the control circuit 156 and the various cushion elements 140, the belt apparatus 102 may employ a single set of leads that are heavier and that continually provide signals to the bags 140 and which, in response to a falling event, can include signals which include an instruction that one or more of the cushion elements 140 are to be expanded. Thus, the belt apparatus 2 may include wired and/or wireless networks that are used to expand the cushion elements 140. Other variations will be apparent.

Further regarding FIG. 9, each belt element 122 (i.e., the belt element 122, the alternate belt element 122A, and any other such belt elements that might be included in the kit 100) includes a belt-side connector portion 148 and a set of belt-side contacts 124A, 124B, 124C, 124D, and 124E, which may be collectively or individually referred to herein with the numeral 124, and which, in the depicted exemplary embodiment, are connected with the cushion elements 140. Other types of connections between the contacts 124 and the cushion elements 140 can be employed depending upon the needs of the particular application. The buckle 126 includes a fastener-side connector portion 142 and a set of fastener-side contacts 130A, 130B, 130C, 130D, and 130E, which may be collectively or individually referred to herein with the numeral 130. The fastener-side connector portion 142 and the belt-side connector portion 148 are movable between a separated configuration physically disconnected from one another, such as is depicted generally in FIG. 10, and an attached configuration physically connected together, such as is depicted generally in FIG. 11. In the attached configuration of FIG. 11, the fastener-side connector portion 142 and the belt-side connector portion 148 are affixed to one another and together form a detachable connector 150 wherein the belt-side contacts 124 are electrically connected with the fastener-side contacts 130 in order to electrically connect together the control apparatus 134 that is situated on the buckle 126 with a protection apparatus 132 and an expansion apparatus 138 but are situated on the belt element 122. The protection apparatus 132, the control apparatus 134, and the expansion apparatus 138 can together be referred to as a safety system 139.

It can be seen that the belt-side contacts 124 and fastener-side contacts 130 are electrically interposed between the control apparatus 130 and the expansion apparatus 138. While the belt-side contacts 124 and the fastener-side contacts 130 are depicted in the exemplary embodiment as each being five in quantity, it is understood that any appropriate quantity of contacts can be employed without departing from the spirit of the disclosed concept.

Either or both of the connector portions 142 and 148 may include deformable structures such as ledges and engagement surfaces and the like that retain the connector portions 142 and 148 connected together as the connector 150 until an appropriate action is taken to separate the connector portions 142 and 148 from one another. Further in this regard, it can be understood that the buckle 126 is connectable with either of the belt element 122 and the belt element 122A to form either of the belt apparatus 102 or the belt apparatus 102A, respectively. In this regard, it can be understood that the kit 100 can be offered with the buckle 126 and the plurality of belt elements 122, such as if the belt elements 122 each had a different physical appearance in terms of each having a different color or otherwise having a different appearance. The buckle 126 could be connected with any of the belt elements 122 as desired in order to generate a desired visual appearance. In a like fashion, any of a plurality of different buckles 126 are cooperable with any of a variety of different belt elements 122 to generate any of it variety of desired visual effects. In each instance the buckle 126 will have resident thereon the safety system 139, except that the protection apparatus 132 and the expansion apparatus 138 will be situated on the relevant belt element 122. This advantageously enables either the belt element 122 or the buckle 126 to be replaced in the event of wear or in the event that different appearance or style combinations are desired by the person 10.

As can further be understood from FIG. 9, the safety system 139 can be said to additionally include a notification apparatus 202 that includes a wireless transceiver 206, a Global Positioning System (GPS) receiver 216 and a storage 226 connected with the control circuit 156. The safety system 139 can further be said to include an arming system 260 that is likewise connected with the control circuit 56. In the depicted exemplary embodiment, the notification apparatus 202 and the arming system 260 are both situated on the buckle 126.

The wireless transceiver 206 is in wireless communication with a receiver 214 and is structured to wirelessly communicate to the receiver 214 an emergency signal 210 such as is described in greater detail elsewhere herein. The GPS receiver 216 is configured to wirelessly receive from a GPS transmitter 220 a GPS signal 222. It is understood that the control circuit can derive from the GPS signal 222 a geographic location of the belt apparatus 102 and thus of the person 10. In this regard, the GPS signal 222 is received continually by the GPS receiver 216 such that the control circuit 156 can at all times derives the current geographic location of the belt apparatus 102 and thus that of the person 10 who is wearing the belt apparatus 102.

It is noted that the arming system 260 includes a switch 264 that is situated on a base 268 of the buckle 126. The buckle 126 further includes a movable tang 272 having a mounted end 276 that is movably situated on the base 268 and a free end 280 opposite the mounted end 276. The tang 272 is movable between a position where the free end 280 is engaged with the base 268 at an engagement location 284 on the base 268, such as is depicted in FIG. 11, and another position wherein the free end 280 is spaced from the base 268, such as is depicted in FIG. 10. While the switch 264 can be situated on either the base 268 or the tang 272, or elsewhere, the switch 264 in the depicted exemplary embodiment is situated on the base 268 at the engagement location 284.

The engagement of the free end 280 with the switch 264 automatically arms the arming system 260. That is, when the free end 280 of the tang 272 is placed in the one state depicted in FIG. 11, it likewise places the switch 264 in one state and thus correspondingly automatically places the arming system 260 in one state, and this results in the safety system 139 being in its own one state which is an armed state. As such, when the tang 272 is received through one of the holes in the end of the belt element 122 to retain the belt apparatus 102 at a selected circumferential length, such as when the belt is being worn by the person 10, the safety system 139 is automatically switched into an armed state and thus will cause the control apparatus 134 to output a trigger signal to cause the expansion apparatus 138 to expand the protection apparatus 132 in a protective fashion when the control apparatus 134 detects a falling event. However, when the tang 272 is in another position, such as is depicted generally in FIG. 10, wherein the free end 280 is disengaged from the switch 264, this places the switch 264 in another state and thus correspondingly also places the arming system 260 in another state, and this results in the safety system 139 being in its own another state, which is an unarmed state. In such a condition, any one or more of the components of the safety system 139 may be unpowered or otherwise disabled in order to resist the control apparatus 134 from causing an expansion of the protection apparatus 132. This advantageously avoids unintended triggering, such as if the belt apparatus 102 were dropped onto a floor after being removed from the trousers.

In the absence of such an automatically operated arming system 260 that advantageously arms the belt apparatus 102 to protectively respond to a falling event when the belt apparatus is being worn by the person 10 and that also advantageously disarms the belt apparatus 102 when removed from person 10, the belt apparatus 102 might undesirably be triggered in a protective fashion when such triggering is unnecessary. Similarly, in the absence of such an automatic arming system 260, such as if the belt apparatus 102 required manual arming, the belt apparatus 102 may be placed into the belt loops of the trousers with the person 10 forgetting to manually place the safety system 139 into its armed state. This would be undesirable since the belt apparatus 102 would not provide protection to the user 10 in a falling event. As such, the arming system 260 advantageous automatically arms the safety system 139 and automatically readies it to provide protective expansion of the protection apparatus 132 when the belt apparatus 102 is being worn by a person 10, but it also prevents such expansion when the belt apparatus 102 is not being worn. This advantageously can also save on battery power when the belt apparatus 102 is not being used.

The sensors 166 can each be said output sensor-based data signals. The notification apparatus 202 stores a set of sensor-based data 228 in the storage 226, and the sensor-based data 228 is a set of data that include the raw signals from the sensors 166 themselves and/or are derived from the signals from the sensors 166. For instance, the sensors 166 are accelerometers in the depicted exemplary embodiment, and the exemplary sensors 166 are oriented orthogonal to one another. The signals from the sensors 166 in the depicted exemplary embodiment are processed by the control circuit 156 to determine a maximum acceleration value at any given time and a maximum angular velocity value at any given time. That is, the person 10 might be accelerating in a direction other than one of the three orthogonal directions along which the sensors 166 are oriented, and the signals from the sensors 166 are therefore processed and combined with one another to determine at all times what is the highest instantaneous value of acceleration of the belt apparatus 102, and therefore of the person 10, in whatever direction the maximum acceleration is occurring. Similarly, the outputs from the sensors 166 are processed by the control circuit 156 to determine highest instantaneous value of angular velocity that the belt apparatus 102 is undergoing about whatever axis the angular movement is occurring. In the depicted exemplary embodiment, the control circuit 156 advantageously monitors the current acceleration and angular velocity values and detects the existence of a falling event whenever either the current acceleration exceeds a predetermined acceleration value or the angular velocity exceeds a predetermined angular velocity value. That is, the exceeding of either such predetermined value without necessarily exceeding both will still result in the control apparatus 134 detecting the existence of a falling event and outputting the trigger signal to the expansion apparatus 138. In the depicted exemplary embodiment, the predetermined acceleration value which, if exceeded, results in the outputting of a trigger signal is an acceleration value of five meters per second squared. Furthermore in the depicted exemplary embodiment, the predetermined angular velocity value which, if exceeded, results in the outputting of a trigger signal, is in angular velocity of 150° per second. As such, the control apparatus 134 advantageously outputs the trigger signal and causes the expansion apparatus 134 to protectively expand at least a portion of the protective apparatus 132 whenever either such predetermined value is exceeded, whether or not both are exceeded. It is understood that different threshold values for acceleration and angular velocity can be employed without departing from the spirit of the instant disclosure.

Further regarding the aforementioned storage of sensor-based data 228 in the storage 226, is understood that the storage 226 is non-volatile storage or other storage that is capable of being repeatedly overwritten. As such, the notification apparatus 202 continually stores in the storage 226 the sensor-based data 228 and, in so doing, typically will overwrite previous data that was stored in the past. As such, the storage 226 at any given time can be said to include sensory-based data 228 that corresponds with occurrences during a predetermined and limited period of time in the past, i.e., prior to the current time, and is typically whatever amount of data is capable of being stored in the storage 226. As new sensory-based data 228 is received, it is stored in the storage 226 and overwrites previous sensory-based data 228 which is considered to be no longer necessary to retain. However, when the control apparatus 134 detects the existence of a falling event, the control apparatus 134 advantageously causes whatever portion of the stored sensor-based data 228 that corresponds with a predetermined period of time prior to the detection of the initiation of the falling event to be inviolate in the storage 226 and to be incapable of being overwritten until a predetermined event occurs, such as the downloading of the inviolate sensor-based data 228 data by appropriate medical personnel for review, or other predetermined event.

Figure 13:
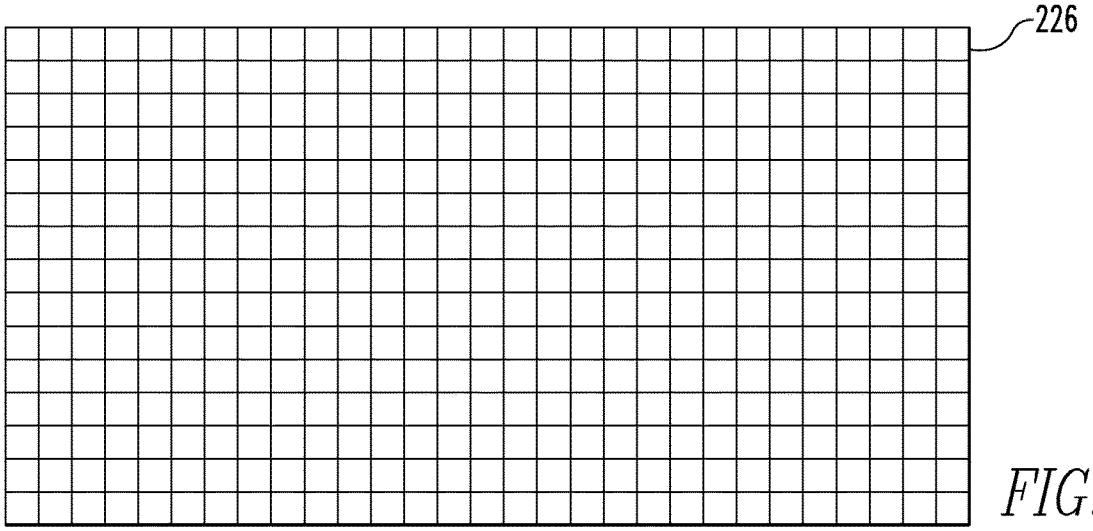
FIG. 13 is a schematic depiction of a portion of the storage of the second embodiment.
Figure 14:
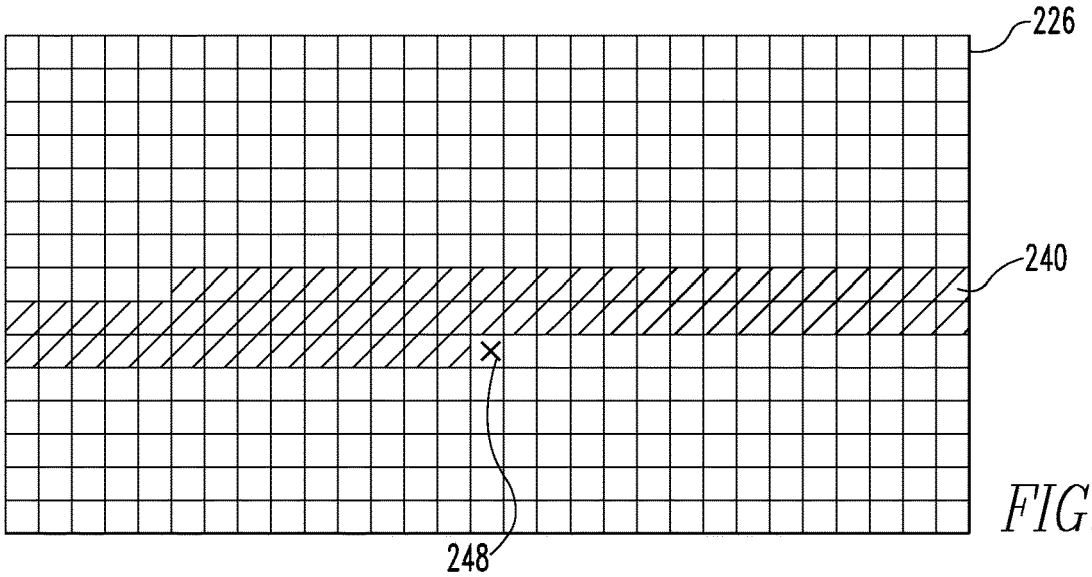
FIG. 14 is a view similar to FIG. 13 except depicting a portion of the storage being un-rewritable after the detection of in initiation of a falling event.
Figure 15:
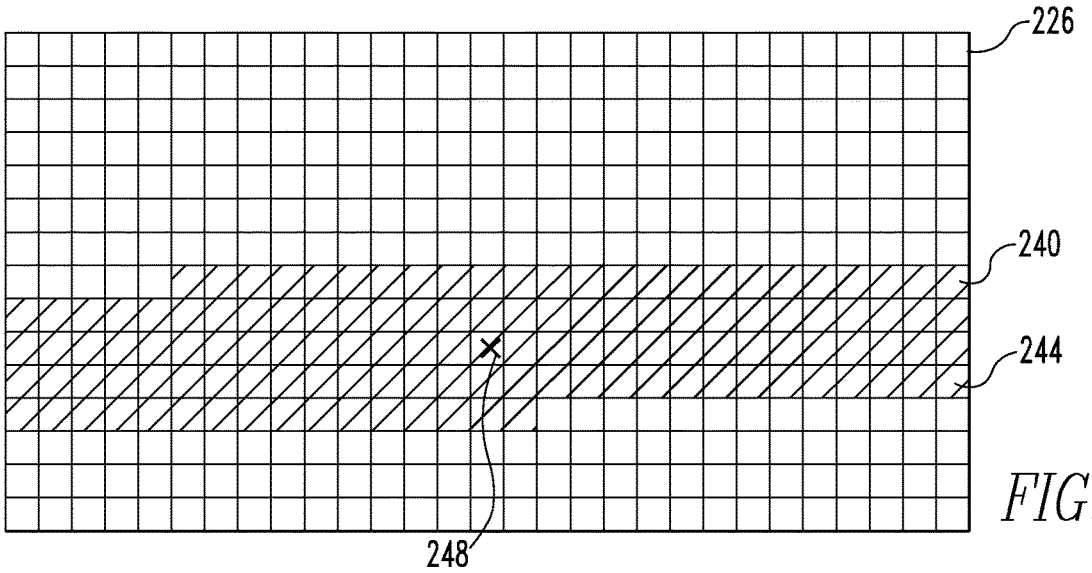
FIG. 15 is a view similar to FIG. 14 except depicting an additional portion of the storage being un-rewritable after the detection of the initiation of the falling event.

FIG. 13 generally depicts a portion of the storage 226 having a plurality of data registers, each of which can be repeatedly overwritten in the absence of the detection of a falling event. However, and as is depicted in FIG. 14, at the moment of the detection of an initiation of a falling event, such as is indicated as the numeral 248, the portion of the storage 226 having stored therein the signal-based data 228 that was recorded during a predetermined period of time prior to the detection initiation of the falling event is rendered non-writable and thus inviolate and permanently stored, as in a first non-writable region that is indicated at 240 in FIG. 14. In the depicted exemplary embodiment, the period of time of the sensor-based data 228 that is retained in the storage 226 is five minutes' worth of sensory-based data 228, although greater and lesser amounts of time can be specified depending upon the needs of the particular application. Furthermore, and as is depicted generally in FIG. 15, the sensor-based data 228 that is stored in the storage 228 subsequent to the moment 248 of the detection of the initiation of the falling event will also be stored in the storage 226 and likewise be stored therein in an inviolate and permanent fashion in a second non-writable region 244 in the storage 226. This second non-writable region 244 may include sensor-based data 228 that is stored in an inviolate fashion for a predetermined period of time after the detection 248 of the falling event, or it may continue until the storage 226 is full or until such storing is otherwise ceased.

It is noted that such inviolate and permanent storage of the sensor-based data 228 in the first and second non-writable regions 240 and 244 remains stored as such only on a temporary basis, meaning that those regions of the storage 226 can be returned to regular re-writable status upon occurrence of the predetermined event, such as downloading of the data in the first and second non-writable regions 240 and 244 by appropriate medical personnel, or other such predetermined event. The point is to ensure that data which pertains to the falling event is retained in the storage 226 and is capable of being retrieved at some point in the future, and that such data remains inviolate within the storage 226 until such retrieval has occurred. After such retrieval has occurred, the storage 226 can be returned to its original state wherein the first and second non-writable regions 240 and 244 are returned to re-writable status.

The storage 226 additionally can have stored therein a medical history 232 of the person 10 and can further have stored therein a narrative report template 236. In the event that the control apparatus 134 detects an initiation of a falling event, the control apparatus 134 takes certain actions such as are set forth elsewhere herein. Advantageously, and in response to a detection of an initiation of a falling event, the control apparatus 134 causes the notification apparatus 202 to output the emergency signal 210 to the receiver 214.

The emergency signal 210 can itself take many forms. For instance, the emergency signal 210 might include a location component that includes a location where the belt apparatus 102 was situated when the falling event was first detected. By way of example, the location component may be based in whole or in part upon the GPS signal 222 that is received by the GPS receiver 216. The emergency signal 210 might additionally include a date and time component that are representative of the moment at which the detection of the initiation of the falling event occurred and may additionally include a medical record component. The medical record component of the emergency signal to 10 might include, for instance, some or all of the medical history 232 that is already stored in the storage 226. Additionally or alternatively, the emergency signal 210 might include as a part of the medical record component an instruction to forward a medical history of the person 10 from a different storage location to the receiver 214. This could occur, for example, if the emergency signal 210 included an instruction that the medical history stored by the insurance company used by the person 10 is to be forwarded to an ambulance crew that is dispatched to the location at which the falling event occurred, by way of example.

Figure 12:
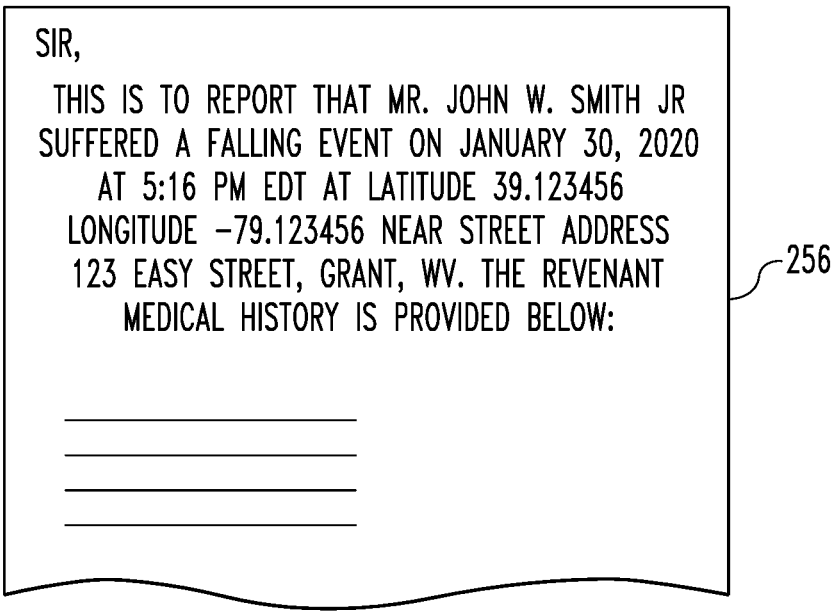
FIG. 12 is an exemplary depiction of a narrative report that is provided as part of an emergency signal.

Further advantageously, the notification apparatus 202 may include a number of routines to 52 that are stored in the storage 226 and that are executable on the control circuit 156 in order to cause the emergency signal 210 to include a narrative report 256 such as is indicated generally in FIG. 12 and which includes various data in the form of a narrative report 256. For instance, the exemplary narrative report 256 includes an identity of the person 10, a description of the occurrence as being a falling event, the date and time of the falling event and the location at which the falling event occurred. The exemplary narrative report 256 additionally includes the medical history of the person 10 that is based upon the medical history 232 that was already stored in the storage 226. As mentioned elsewhere herein, the medical history of the person 10 need not necessarily be stored directly in the storage 226 as long as the routines 252 and the wireless transceiver 206 are able to access the location where the medical history is stored or are at least capable of sending an instruction that the medical history is to be forwarded from one location to another as needed in order to best assist the person 10. Other benefits will be apparent.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A belt apparatus structured to support on a person a trousers having a number of belt loops that are situated on an exterior surface of the trousers, the belt apparatus comprising:

a trouser support apparatus comprising an elongated and flexible belt element having a number of cavities formed therein, the belt element being structured to be received in the number of belt loops of the trousers to thereby assist in supporting the trousers at the waist of the person;

a protection apparatus comprising a number of cushion elements that are each structured to be movable from a configuration situated within a cavity of the number of cavities to another configuration situated at least partially outside the cavity and in protective proximity to a body part of the person;

a control apparatus comprising a number of sensors that are structured to output a number of sensor signals, the control apparatus being structured to generate a trigger signal that is responsive to a detection of an initiation of a falling event of the person and that is based at least in part upon the number of sensor signals;

an expansion apparatus which, responsive to the trigger signal, is structured to expand at least a first cushion element of the number of cushion elements from the configuration to the another configuration; and a notification apparatus comprising a storage; and the control apparatus being structured and configured to perform operations comprising:

periodically storing in the storage data that is based upon at least a portion of the number of sensor signals and in so doing periodically overwriting portions of the storage with the data; and responsive to the trigger signal, resisting the overwriting of a portion of the storage having stored therein a subset of the data that is based upon the at least portion of the number of sensor signals from a predetermined time prior to the detection of the initiation of the falling event through at least the detection of the initiation of the falling event.

2. The belt apparatus of claim 1 wherein the operations further comprise resisting the overwriting of the portion of the storage having stored therein as the subset of the data a portion of the data that is based upon the at least portion of the number of sensor signals from the predetermined time prior to the detection of the initiation of the falling event through another predetermined time subsequent to the detection of the initiation of the falling event.

3. The belt apparatus of claim 1 wherein the operations further comprise, responsive to a predetermined event, permitting overwriting of the portion of the storage.

4. A belt apparatus structured to support on a person a trousers having a number of belt loops that are situated on an exterior surface of the trousers, the belt apparatus comprising:

a trouser support apparatus comprising an elongated and flexible belt element having a number of cavities formed therein, the belt element being structured to be received in the number of belt loops of the trousers to thereby assist in supporting the trousers at the waist of the person;

a protection apparatus comprising a number of cushion elements that are each structured to be movable from a configuration situated within a cavity of the number of cavities to another configuration situated at least partially outside the cavity and in protective proximity to a body part of the person;

a control apparatus comprising a number of sensors that are structured to output a number of sensor signals, the control apparatus being structured to generate a trigger signal; and an expansion apparatus which, responsive to the trigger signal, is structured to expand at least a first cushion element of the number of cushion elements from the configuration to the another configuration; and the control apparatus being structured and configured to perform operations comprising:

determining from the number of sensor signals an acceleration of the person;

determining from the number of sensor signals an angular velocity of the person;

making a determination that at least one of the acceleration is exceeding a predetermined acceleration value and the angular velocity is exceeding a predetermined angular velocity value;

detecting an initiation of a falling event of the person that is based at least in part upon the determination and, responsive thereto, generating the trigger signal; and wherein the operations further comprise generating the trigger signal when either of:

the acceleration exceeds five meters per second squared as the predetermined acceleration value; and the angular velocity exceeds one hundred fifty degrees per second as the predetermined angular velocity value.

5. The belt apparatus of claim 4 wherein the configuration is a collapsed configuration.

* * * * *